US010335941B2

(12) United States Patent
Heinz

(10) Patent No.: US 10,335,941 B2
(45) Date of Patent: Jul. 2, 2019

(54) MARKING TEMPLATE TOOL

(71) Applicant: Susan Mallory Heinz, White Bear Lake, MN (US)

(72) Inventor: Susan Mallory Heinz, White Bear Lake, MN (US)

( * ) Notice: Subject to any disclaimer, the term of this patent is extended or adjusted under 35 U.S.C. 154(b) by 126 days.

(21) Appl. No.: 15/152,112

(22) Filed: May 11, 2016

(65) Prior Publication Data

US 2016/0332294 A1 Nov. 17, 2016

Related U.S. Application Data

(60) Provisional application No. 62/160,071, filed on May 12, 2015, provisional application No. 62/160,066, filed on May 12, 2015.

(51) Int. Cl.
*B25H 7/02* (2006.01)
*B25H 7/04* (2006.01)

(52) U.S. Cl.
CPC ..... *B25H 7/04* (2013.01); *B25H 7/02* (2013.01)

(58) Field of Classification Search
CPC ..... B25H 7/02; B25H 7/04
USPC ..... 33/666, 563, 565, 19.3, 27.01, 27.032
See application file for complete search history.

(56) References Cited

U.S. PATENT DOCUMENTS 807,758 A * 12/1905 Marx ..... B25H 7/04 33/666
2,212,703 A * 8/1940 Suffich ..... B43L 13/02 33/1 B
D134,627 S * 12/1942 Harrison ..... 33/565
D137,905 S * 5/1944 Kardux ..... 33/565
2,364,529 A * 12/1944 Hill ..... B43L 13/20 16/429
2,500,873 A * 3/1950 Sager ..... G11B 3/34 33/563
3,230,624 A * 1/1966 Fisher ..... B43L 11/08 33/27.01
3,795,053 A * 3/1974 Burke ..... B43L 9/002 33/1 B
4,129,948 A * 12/1978 Hatter ..... B43L 9/002 33/27.03
4,530,156 A * 7/1985 Kettlestrings ..... B43L 9/002 33/27.01
5,050,309 A * 9/1991 Wang ..... B43L 7/04 33/27.03
5,125,161 A * 6/1992 Guthrie ..... B43L 9/002 33/27.01
5,511,316 A * 4/1996 Fischer ..... B26D 3/24 33/1 F
5,791,062 A * 8/1998 Walker ..... D05B 97/12 33/1 B (Continued)

*Primary Examiner* — Yaritza Guadalupe-McCall
(74) *Attorney, Agent, or Firm* — Daniel J. Polglaze; Westman, Champlin & Koehler, P.A.

(57) ABSTRACT

A tool for inscribing markings onto a medium includes a body with a mounting hole, and at least one slit extending in a line that intersects the mounting hole toward an outer edge of the body, and a number of drawing holes in a face of the body, each hole a different predetermined distance from the mounting hole. The body may have at least one marking line spaced from the at least one slit to allow for subdivision of a shape such as a circle inscribed using the tool, by using at least one of the at least one slit, edges of the tool, and the at least one marking line.

18 Claims, 13 Drawing Sheets

(56) References Cited

U.S. PATENT DOCUMENTS

| | | | | |
|---|---|---|---|---|
| 5,987,760 | A * | 11/1999 | Hsu | B43L 9/002 33/27.03 |
| 6,216,354 | B1 * | 4/2001 | Carbone | B43L 13/20 33/27.01 |
| 6,286,216 | B1 * | 9/2001 | Braun | B26D 7/22 30/286 |
| 6,321,457 | B1 * | 11/2001 | Lariviere, Jr. | B26B 29/06 33/562 |
| 7,162,808 | B2 * | 1/2007 | Martin | B25H 7/005 33/27.01 |
| 7,255,051 | B2 * | 8/2007 | Graham | D05B 21/007 112/103 |
| 7,469,483 | B2 * | 12/2008 | Martin | B25H 7/005 33/520 |
| 8,782,912 | B1 * | 7/2014 | Jensen | B43L 9/045 33/27.032 |
| 8,869,417 | B2 * | 10/2014 | Yeh | A41H 3/002 33/565 |
| 2002/0157272 | A1 * | 10/2002 | Haegele | F02F 1/24 33/563 |
| 2005/0252019 | A1 * | 11/2005 | Gordon | B43L 13/20 33/566 |
| 2015/0107127 | A1 * | 4/2015 | Pelland | D06H 7/00 33/566 |
| 2016/0332294 | A1 * | 11/2016 | Heinz | B25H 7/02 |

* cited by examiner

MARKING TEMPLATE TOOL

RELATED APPLICATIONS

This application claims priority to U.S. Provisional Application Ser. No. 62/160,071, filed May 12, 2015, and to U.S. Provisional Application Ser. No. 62/160,066, filed May 12, 2015.

BACKGROUND

In the quilting/home craft industry, there is a need to be able to mark circles of many sizes onto various surfaces such as paper and fabric with ease. Specialty rulers and shapes are available, but most are limited to either whole or half-inch increments. Non-standard size circles are typically not supported. Many of the marking tools used, e.g.: chalk, washout markers, specialty pens and pencils are too large (both in shaft width and point end size) to fit into traditional drafting compasses, even with specialty adaptors. To be able to find a center of a shape (circles and squares for example) and accurately divide and section these shapes—while accommodating a variety of marking devices—requires several tools to accomplish the one task. Further, compasses and other marking tools require calculations and additional items such as straightedges and the like, making easy marking difficult.

SUMMARY OF DISCLOSURE

The Circleliner™ marking template tool is a highly functional, flexible, transparent and non-breakable plastic template that acts like both a compass and a straightedge for divisions of half, quarter, eighths and sixteenths. It accommodates a wide variety of marking tools with ease. 90 circle sizes are available to choose from, all at ⅛" increments—accommodating most every circle size needed up to a 11½" outside diameter—offering both even and odd sizes. It also perfectly aligns concentric circles.

In one embodiment, a tool for inscribing markings onto a medium includes a circular body, the circular body having a mounting hole in a center of the circular body, and at least one slit extending in a line that intersects the center toward an outer edge of the circular body, and a number of drawing holes in a face of the circular body, each drawing hole a different predetermined distance from the mounting hole In another embodiment, a tool for inscribing lines onto a medium includes a wedge-shaped body, the wedge-shaped body encompassing a predetermined arc and having a mounting hole and at least one slit extending from the mounting hole toward an outer edge of the circular body. The wedge-shaped body may further include a number of markings at predetermined angles from an edge of the wedge-shaped body to facilitate even division of a shape into segments according to the markings. The number of markings may include a printed lines on a face of the wedge-shaped body, each of the printed lines at a predetermined angle from an edge of the wedge-shaped body, configured such that the tool may be used to divide a shape into equal segments using the one or more of edges of the wedge-shaped body, the printed lines, and the slit.

In another embodiment, method of inscribing circles and dividing circles into equal segments includes attaching a marking tool to a material using a mounting hole, and inscribing a circle using one of a number of radius holes in the marking tool, the number of radius holes in a face of the marking tool, each radius hole having a different predetermined distance from the mounting hole.

DETAILED DESCRIPTION

Figure 1:
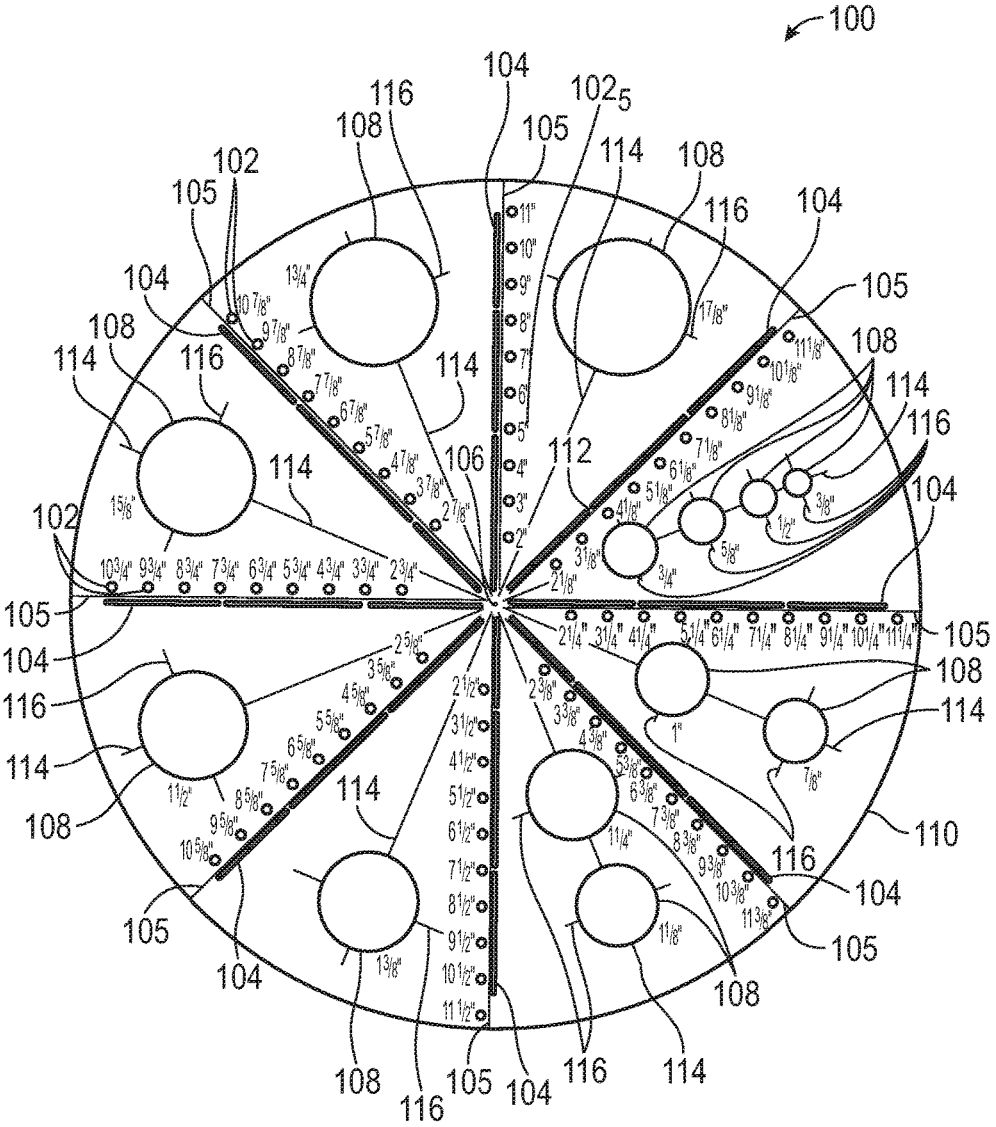
FIG. 1 is a top view of a marking template tool according to an embodiment of the present disclosure.

The Circleliner™ marking template tool 100 is shown in FIG. 1. The marking template tool 100 is used in one embodiment for drawing circles and lines on flat surfaces where a pin can be driven into or through the surface, including but not limited to paper, plastic, wood and fabric. Tool 100 is in one embodiment an 11¾" diameter circle cut from a thin, flexible and translucent plastic. In it are cut 77—radius holes 102 (in one embodiment 7⁄64", in another embodiment ⅛", although it should be understood that holes size may be different without departing from the scope of the disclosure) and 8 slits 104 (in one embodiment 1⁄16" wide, although it should be understood that slit size may be different, and that more or fewer slits could also be used without departing from the scope of the disclosure) radiating from a center point 106. Between the slits are 13 circular cutouts 108, measuring from ⅜" to 1⅞" increasing in $\frac{1}{8}^{th}$ inch increments. (See FIG. 1). Each radius hole 102 is marked with a circle diameter legend, indicating that a circle of that diameter may be drawn using the particular radius hole. For example, to draw a circle with a diameter of 5", the radius hole $\mathbf{102}_5$ is selected, a marking implement is inserted in the radius hole $\mathbf{102}_5$, and a circle is drawn, as described further below, having a diameter of 5". While 77 radius holes with circle diameter options from 2" to 11½" in ⅛" increments are shown, it should be understood that with a different diameter marking template tool 100, additional or fewer radius holes could be provided, and the radius holes could have different separations, to provide for any number of different size circles, depending upon a desired template, all without departing from the scope of the disclosure.

Figure 2:
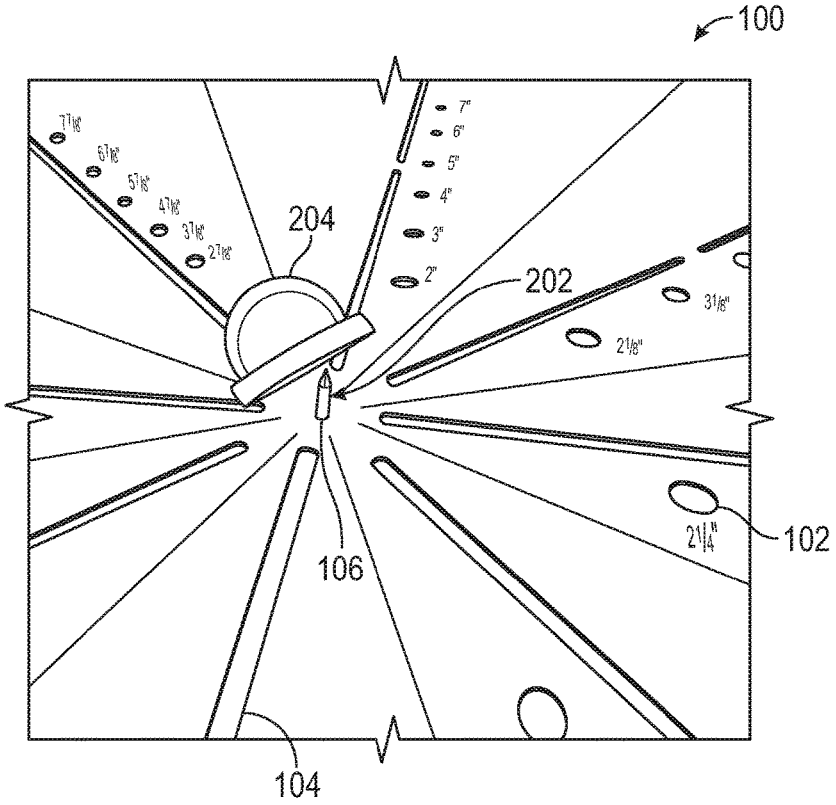
FIG. 2 is a perspective view showing an embodiment of a mounting for the marking template tool of FIG. 1.

The marking template tool 100 is attached to a surface of a material in one embodiment by using a thumbtack 202 and a thumbtack cap 204 (see FIG. 2). The thumbtack 202 is placed point upward beneath the material at the center of a circle to be marked, and is pushed through the material, exposing the thumbtack 202 point. The marking template tool 100 is affixed with the centering hole 106 placed on top of the tack 202 point. The tool 100 is then secured by pushing the cap 204 onto the thumbtack 202 point. (FIG. 2). In the case of a surface such as wood, or a surface that is too thick for the thumbtack 202 to extend fully through the material, the thumbtack 202 may be mounted from the top, through the centering hole 106 in the tool 100, through the design center, and be pushed into the material far enough to hold the tool 100 in place on the material from above.

In one embodiment, the radius holes 102 are aligned with respect to the centering hole 106 such that the furthest portion of each radius hole 102 from the centering hole is at the radius of the circle associated with that hole 102. That is, to mark a circle with a diameter of 5" with a marking implement having a marking point smaller than the diameter of the radius hole 102 associated with the desired circle diameter, Slits 104 in one embodiment have a guide line 105 along a side. The guide lines 105 align with the specific angles along the circle. In this embodiment, each guide line 105 is 45 degrees separated from each adjacent guide line 105. With a marking implement that is narrower than the width of the slit 104, marking on the side of the slot 104 that has the guide mark 105 provides consistent spacing between adjacent guide marks. The slits 104 in one embodiment extend from near the center opening 106 to near the exterior edge 110 of the marking template tool 100. Each slit in one embodiment is not continuous, but has small sections 112 that assist in providing stability and strength to the marking template 100. It should be understood that the slits 104 could be continuous, or could have more or fewer sections 112 without departing from the scope of the disclosure.

Marking template tool 100 further has, in one embodiment, secondary marking lines 114 between slits 104, the secondary marking lines 114 also extending radially from at or near the center opening 106. In the embodiment shown in FIG. 1, secondary marking lines 114 are positioned at a midpoint angle between slits 104. That is, with slits 104 separated by 45 degrees, secondary marking lines 114 are positioned at 22.5 degrees from each slit 104, with the secondary marking lines 114 therefore also separated by 45 degrees. The secondary marking lines 114 in one embodiment divide the circular cutouts 108 in half radially, Each circular cutout also has a circle dividing line 116 that extends perpendicular to the secondary marking line 114 of each circular cutout 108. This allows each circular cutout 108 to be aligned for concentric marking of its circle about the center of a set of concentric circles by aligning the secondary marking line 114 and the circle dividing line 116 with marked radius lines drawn using slits 104.

Slits 104 are used in one embodiment to divide drawn circles, or other shapes, into equal sections. With 8 radial slits 104 positioned at 45 degree angles around the marking template tool 100, a shape may be easily divided into halves, quarters, or eighths without anything other than the slits. This is accomplished in one embodiment by marking along the guide line 105 of two slits (opposite for dividing the circle into halves), four slits (at 90 degree angles for dividing the circle into quarters), or eight slits (for dividing the circle into eights). The secondary marking lines 114 are used in one embodiment to further divide a circle or other shape into smaller increments that the slits 104 alone allow. By rotating the marking template tool 100 about the center opening 106 to align the secondary marking lines with already drawn lines, the shape can be further divided into sixteenths, by marking the eight slits 104 after rotation of the tool to align the secondary marking lines with the already drawn dividing lines. It should be understood that while eight secondary marking lines 114 are shown, additional secondary lines could be marked on marking template tool 100 to further increase the number of divisions into which a shape could be divided, without departing from the scope of the disclosure.

Similarly, a protractor portion or protractor separately rotatable from the marking template tool 100, may be attached at the center opening 106 for relative rotation between the marking template tool 100 and the protractor portion or protractor could be employed, wherein the marking template tool 100 has fewer slits 104, and divisions may be drawn using even a single slit 104 by aligning, for example, an edge of the protractor portion with a drawn line and using the slit 104 at a specific angle from the edge of the protractor to draw another line. This configuration allows a user to choose the division size depending upon the granularity of the markings on the protractor or protractor portion. However, such a configuration requires a user to make a determination, as opposed to following a template for marking divisions.

Small circular cutouts 108 are provided in marking template tool 100. The circular cutouts are circles that have a diameter smaller than the circles that may be drawn with the radius circles, and in one embodiment are provided in ⅛" increments from 1⅞" to ⅜". Although ⅛" increments are shown, it should be understood that different increments, and a different number of circular cutouts 108 could be provided without departing from the scope of the disclosure.

Figure 3:
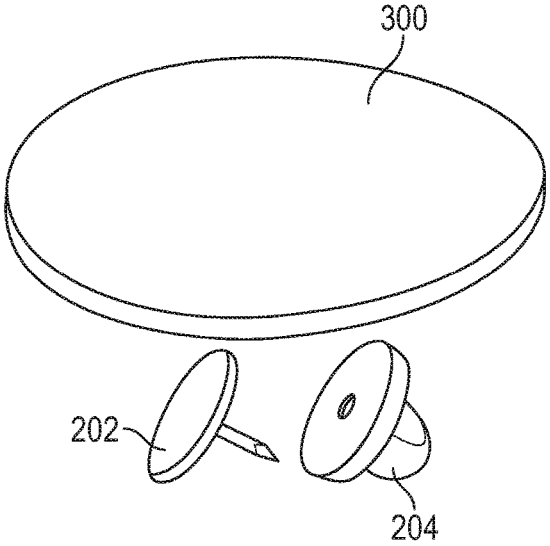
FIG. 3 is a perspective view of an embodiment of mounting apparatus for embodiments of the marking template tool.

A perspective view of a thumbtack 202, cap 204, and backer plate 300 are shown in FIG. 3. Backer plate 300 is in one embodiment a rubber disc, such as neoprene. It may be used when a material to be marked is in a position such that no hard backing or support is present. Such a situation includes a piece of material such as fabric that is stretched between two supports, or on a long arm sewing or quilting machine, or the like. In combination with a pin, the backing disc 300 provides a support for the marking template tool on a piece of material. The process of use of the backing disc 300 is discussed further below with respect to FIG. 9.

Drawing Circles

Figure 4:
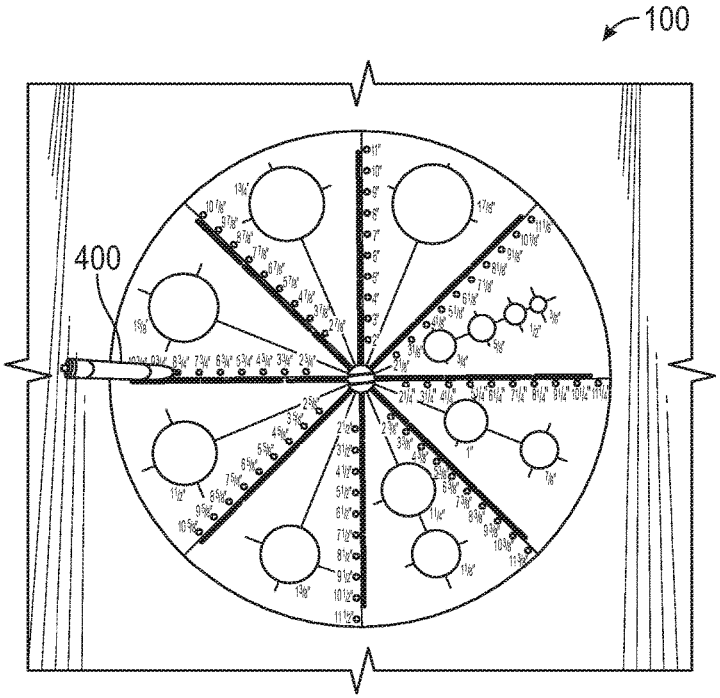
FIG. 4 is a top view of an embodiment of the present disclosure in use.
Figure 5:
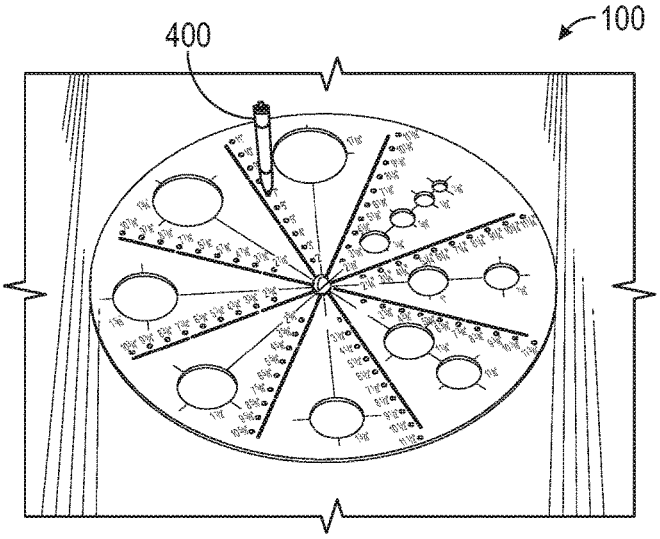
FIG. 5 is a perspective view of an embodiment of the present disclosure in use.
Figure 6:
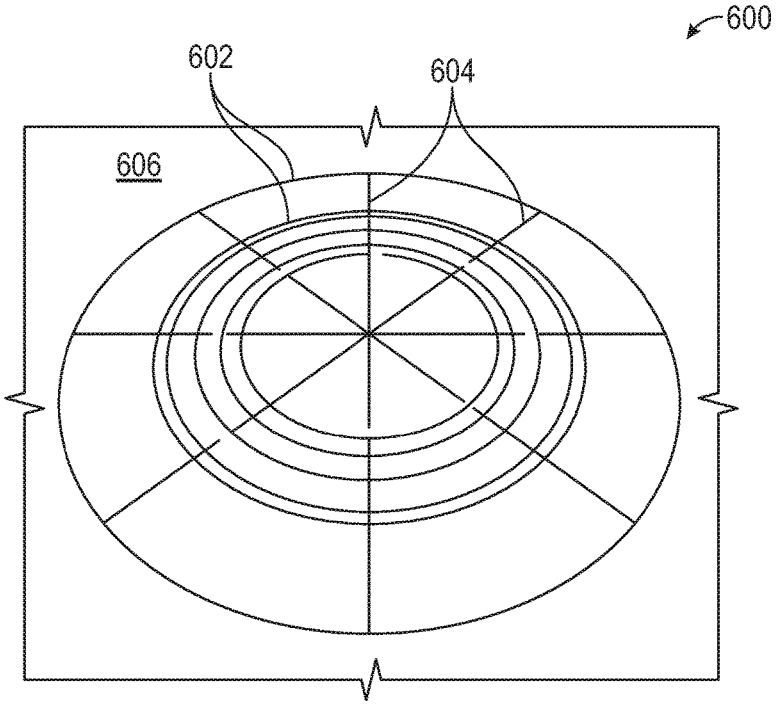
FIG. 6 is a view of a pattern drawn using an embodiment of the present disclosure.

In operation, once attached to a material to be marked, the marking template tool 100 can be used to draw and divide circles ranging from 2" to 11½" in ⅛" increments, using one of the 77 pre-drilled radius holes 102 in the surface of the marking template tool 100 and a marking implement or drawing tool with an end point up to ⅛" thick, and to draw smaller circles using the circular cutouts 108. Drawing circles using the radius holes 102 is done by placing the tip of the marking implement 400 (e.g., pen, pencil, chalk pencil) into the radius hole 102 that corresponds to the size of the circle to be drawn, and then spinning the marking template tool 100 a full rotation (360°) while applying downward pressure on the drawing tool tip. (See FIGS. 4-6). FIG. 6 shows an example of concentric circles 602 marked on a material 606 using radius holes 102 and a marking implement such as implement 400, and subdivided by marked dividing lines 604 marked using slits 104 and a marking implement such as implement 400.

Figure 7:
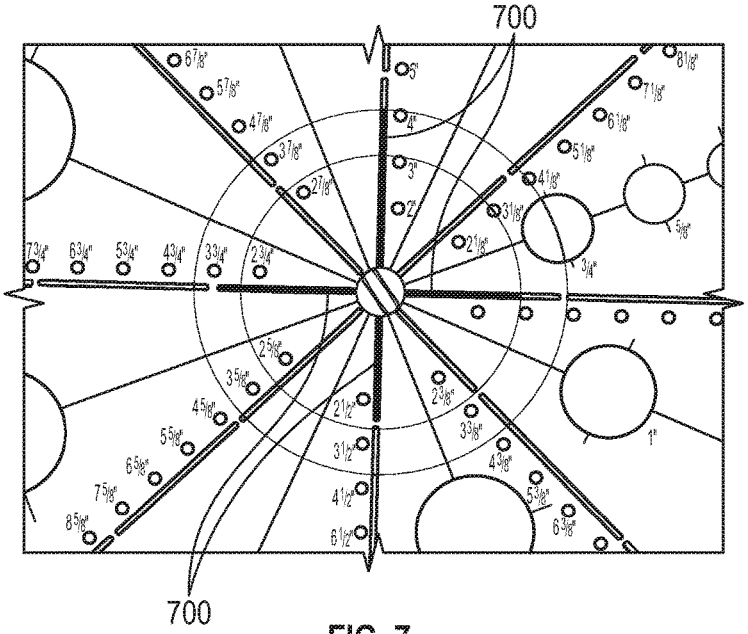
FIG. 7 is a close-up view of slits for compass point marking according to an embodiment of the present disclosure.
Figure 8A:
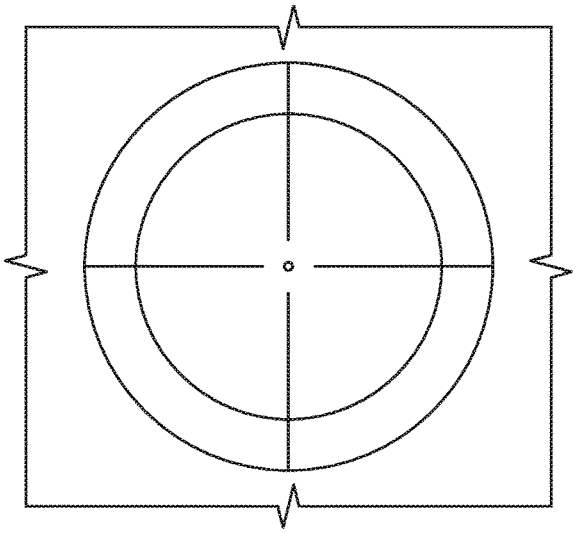
FIGS. 8A and 8B are views of marked compass points (FIG. 8A) and use thereof with a tool (FIG. 8B) according to an embodiment of the present disclosure.
Figure 8B:
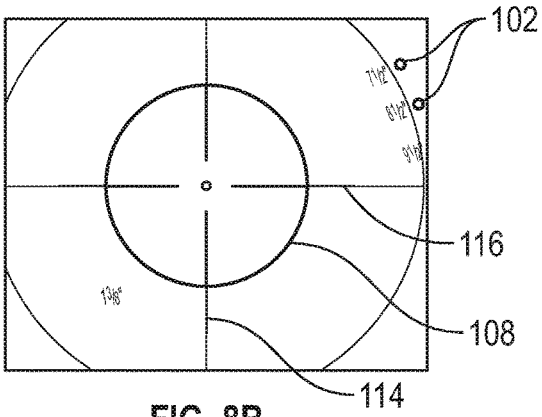

The 13 circular cutouts 108 on the tool 100 can be used to draw smaller circles from ⅜" to 1⅞" with no spinning of the tool 100 required. A secondary marking line 114 bifurcates each of the cutouts 108, and the secondary marking lines 114 and the circle dividing lines 116 form four compass point lines at each of the circular cutouts 108, and can be used to center the circle to be marked. (See FIGS. 7-8).

While a specific number of pre-drilled radius holes are disclosed, and a specific increment between concentric circles to be formed with the pre-drilled radius holes, are disclosed, it should be understood that greater or fewer holes and different increments may be used without departing from the scope of the disclosure. Further, a greater or fewer number of circular cutouts, and cutouts of different sizes, as well as a tool of a different overall diameter, may also be used without departing from the scope of the disclosure.

Figure 14:
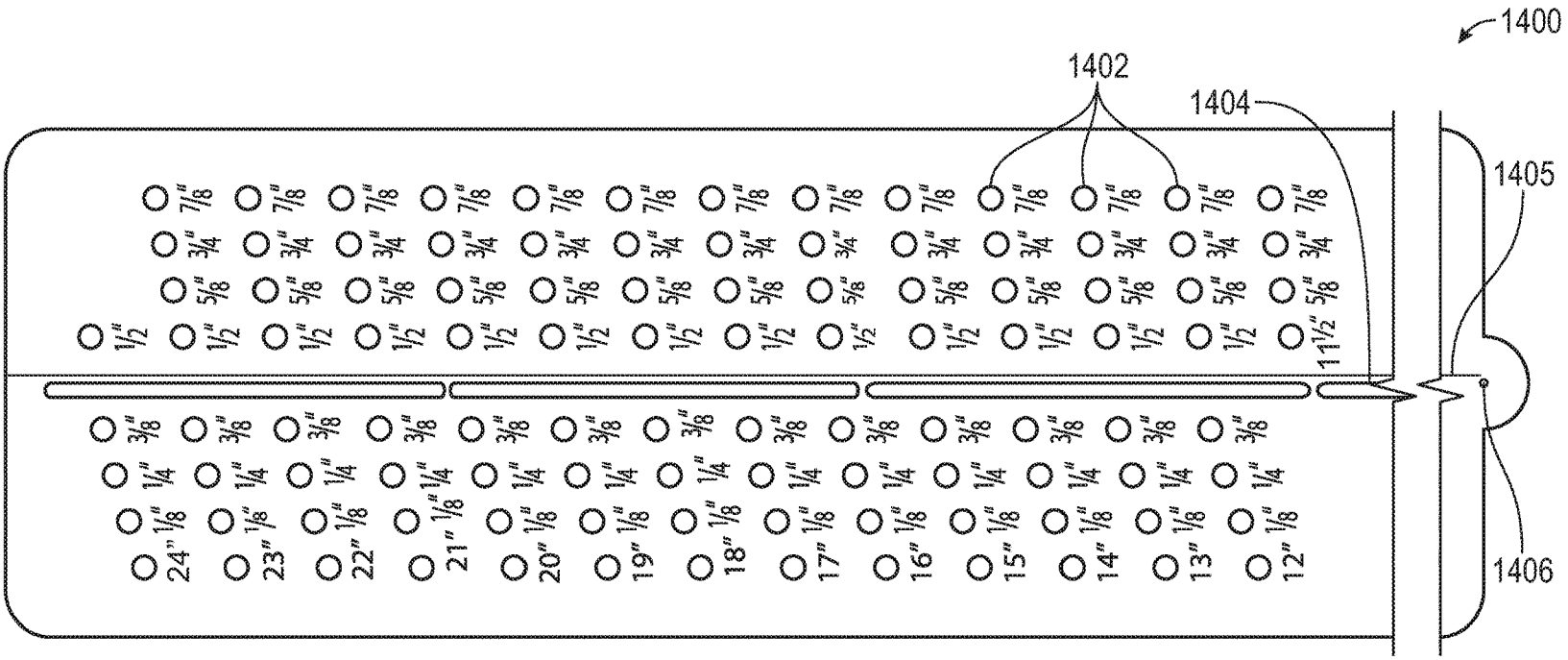
FIG. 14 is a view of an extender according to another embodiment of the present disclosure.

Further, an extension 1400 is contemplated (See FIG. 14) in which additional circle sizes are enabled, using a substantially rectangular (described but could be a different shape), flexible, translucent plastic extension having radius holes 1402, a slit 1404 with guide line 1405, and a centering hole 1406. The centering hole 1406 may be attached to a material with the thumbtack 202 and cap 204 or backing disk 300 and pin 902 as described herein, and circles of any diameter up to the limits of plastic extension may be marked.

Drawing Lines

The slits 104 are also used in one embodiment to divide pre-drawn circles into halves, quarters, eighths or sixteenths with ease. The slits 104 can also be used to pre-mark centered compass points to which the smaller 13 circular cutouts 108 can be aligned, centered and drawn.

Figure 10:
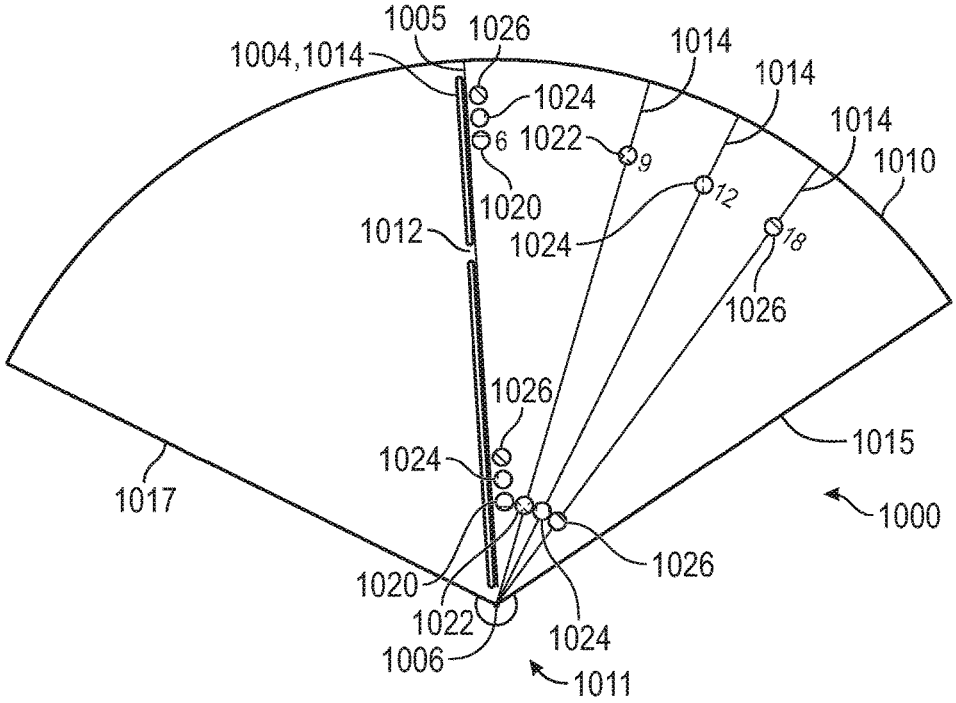
FIG. 10 is a top view of a tool for creating segments in multiples of three, according to an embodiment of the present disclosure.
Figure 11:
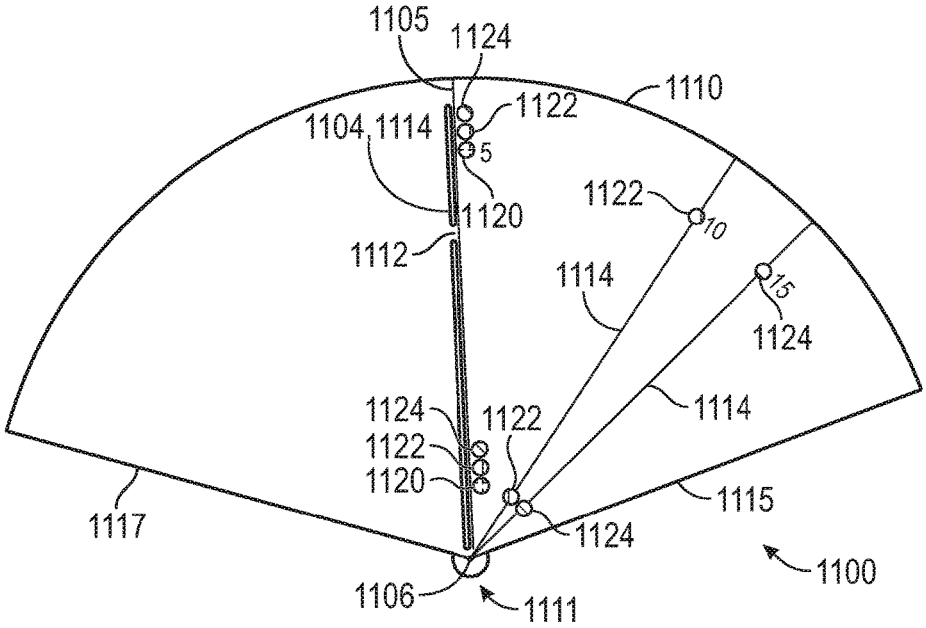
FIG. 11 is a top view of a tool for creating segments in multiples of five, according to an embodiment of the present disclosure.

The TriLiner™ marking template tool 1000 and PentaLiner™ marking template tool 1100 are shown in FIGS. 10 and 11, respectively, and are highly functional, flexible, transparent and non-breakable plastic templates of similar material as that of marking template tool 100. The tools 110 and 1200 can easily divide any shape with an outside dimension of 11½" or less. The tool 1000 is designed to divide shapes (e.g., circles, but other shapes may be accommodated) into 3, 6, 9, 12 or 18 segments. The tool 1100 is designed to divide any shape into 5, 10 or 15 segments. Each tool is in one embodiment color coded for each segment division, making both teaching others how to use the tools 1000 and 1100, and using the tools 1000 and 1100, straightforward and much less prone to error than a traditional protractor.

The tools 1000 and 1100 are especially useful with pre-drawn circles, such as those described above and drawn with the marking template tool 100

The tools 1000 and 1100 are used for dividing shapes into odd-numbered increments, e.g., thirds, fifths, ninths. They are capable of use, in one embodiment, on flat surfaces that a pin or thumbtack such as thumbtack 200 can be driven into or through, including but not limited to paper, plastic, wood and fabric. The tools 1000 and 1100 are made out of thin, flexible and translucent plastic, upon which are printed numbered and color-coded segment dividing lines 1002 and 1102 respectively. The marking template tool 1000 is wedge shaped with an arc of 120°. The marking template tool 1100 is wedge shaped with an arc of 144°.

For tool 1000, one 1/16" wide slit 1004 radiates from a center point 1006 toward the outer edge 1010 of the tool 1000, bisecting the wedge. At a base 1011 of the wedge is a centering hole 1006 used for centering the tool 1000 over the shape to be divided. For tool 1100, one 1/16" wide slit 1104 radiates from a center point 1106 toward the outer edge 1110 of the tool 1100, bisecting the wedge. At a base 1111 of the wedge is a centering hole 1106 used for centering the tool 1100 over the shape to be divided. As with the slits 104 described above, the slits 1004 and 1104 are also in one embodiment provided with guide lines 1005 and 1105 and small sections 1012 and 1112 that assist in providing stability and strength to the tools 1000 and 1100. Further, it should be understood that slit size may be different, that more or fewer slits could also be used, that the slits 1004 and 1104 could be continuous, or could have more sections 1012 or 1112 without departing from the scope of the disclosure.

Color-coded (using colored dots), printed lines 1014 and 1114 radiate from each of the center points 1006 and 1106 of the tools 1000 and 1100, respectively. Tool 1000 has four lines 1014 at arcs of 20°, 30°, 40° and 60° from edge 1015, with the arc at 60° also identified as guide line 1005. Tool 1100 has three lines 1114 at arcs of 24°, 36° and 72° from edge 1115, with the arc at 72° also identified as guide line 1105. By rotating the tools 1000 and 1100 around the centering point 1006 or 1106, and drawing lines along the edges 1015, 1115 and slits 1004, 1104 of the tools 1000, 1100, shapes can be divided into 3, 6, 9, 12 and 18 segments using the tool 1000; and 5, 10 and 15 segments using the tool 1100. Color-coding indicates when to use the slit 1004 or 1104 in addition to the edges 1015, 1115 of the tools 1000, 1100 to draw dividing lines. Some increments in the tool 1000 do not use the slit 1104, but instead use only outer edge 1015 or outer edge 1017 to segment the shapes, as is described in greater detail below.

While a specific number of pre-cut slits 1004, 1104 are disclosed, and a specific increment between dividing lines 1014, 1114 to be drawn with the slits are disclosed, it should be understood that greater or fewer slits and different increments may be used without departing from the scope of the disclosure. Further, a greater or fewer number of slits, as well as a tool of a different overall diameter, may also be used without departing from the scope of the disclosure.

It should further be understood that while tools are described with the ability to divide shapes into segments in factors of three and five herein, additional tools may be employed to divide shapes into other factors without departing from the scope of the disclosure.

Using the Tools 1000 and 1100

The tool (1000 or 1100) is attached to a flat surface by using a thumbtack and a thumbtack cap. The thumbtack is placed point upward beneath the material at the center of the circle to be marked and pushed through the material, exposing the thumbtack point. The Tools are affixed with the centering hole placed on top of the tack point. It is then secured by pushing the cap onto the thumbtack point as described above with reference to FIG. 2 or 9.

FIG. 10 also shows dots marking the $6^{ths}$, $9^{ths}$, $12^{ths}$, and $18^{ths}$ marking options for tool 1000. In one embodiment, the dots are color coded. For illustration purposes, the $6^{th}$ dots are identified as 1020, the $9^{th}$ dots are identified as 1022, the $12^{th}$ dots are identified as 1024, and the $18^{th}$ dots are identified as 1026.

FIG. 11 also shows dots marking the $5^{ths}$, $10^{ths}$, and $15^{ths}$ marking options for tool 1100. In one embodiment, the dots are color coded. For illustration purposes the $5^{th}$ dots are identified as 1120, the $10^{th}$ dots are identified as 1122, and the $15^{th}$ dots are identified as 1124.

Figure 12A:
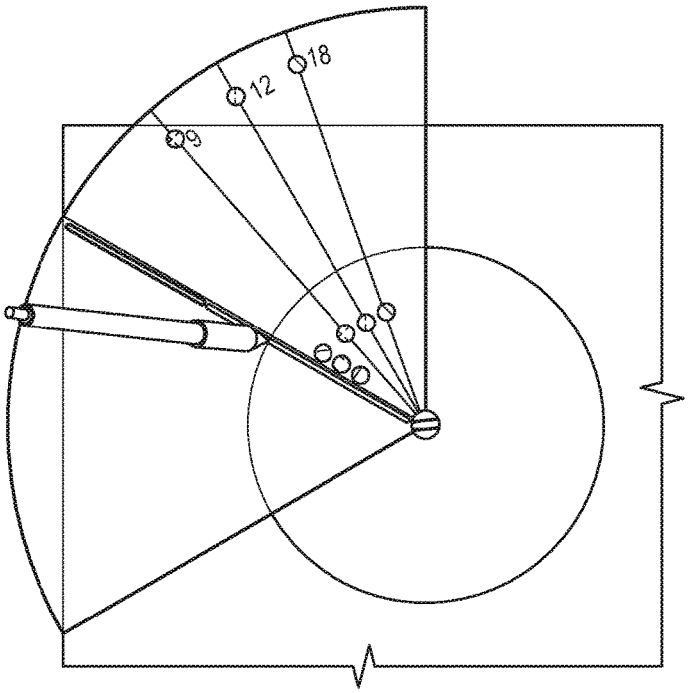
FIGS. 12A-12G show a tool in use to segment a shape into 12 segments.
Figure 12B:
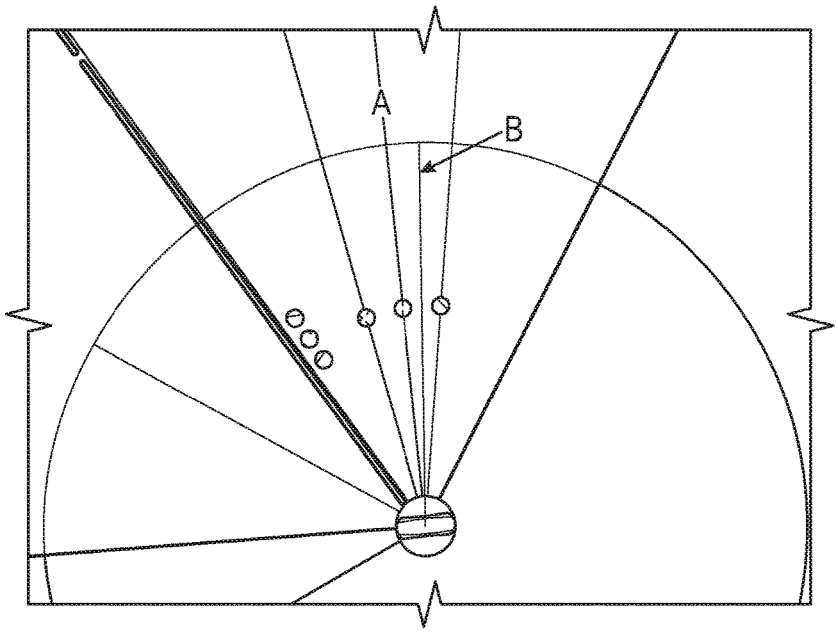
Figure 12C:
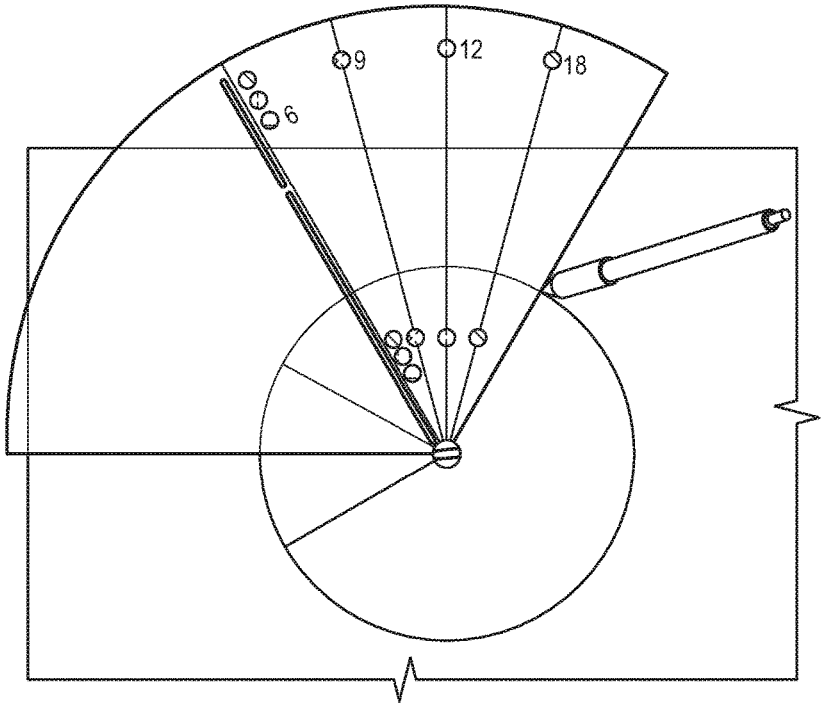
Figure 12D:
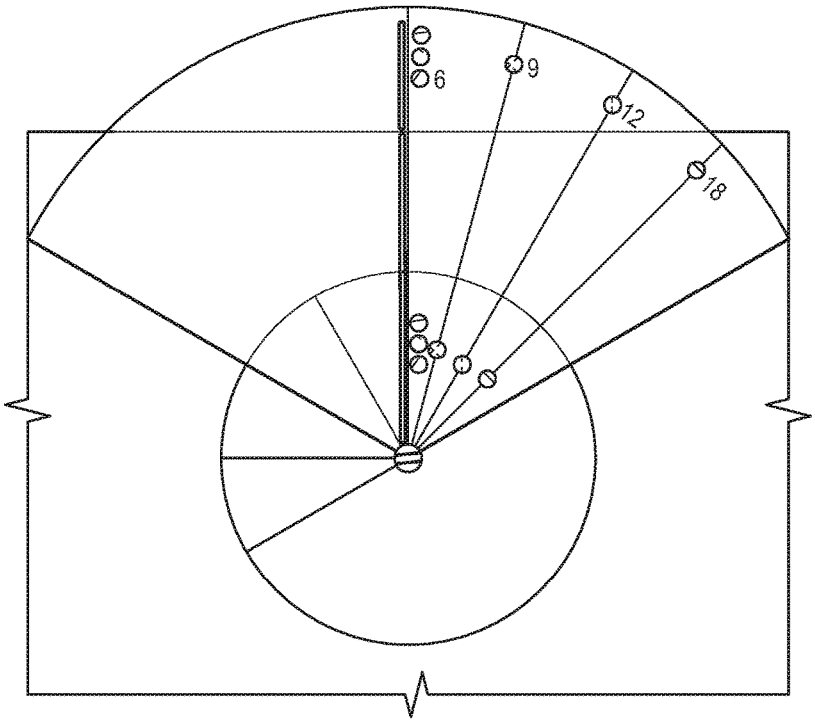
Figure 12E:
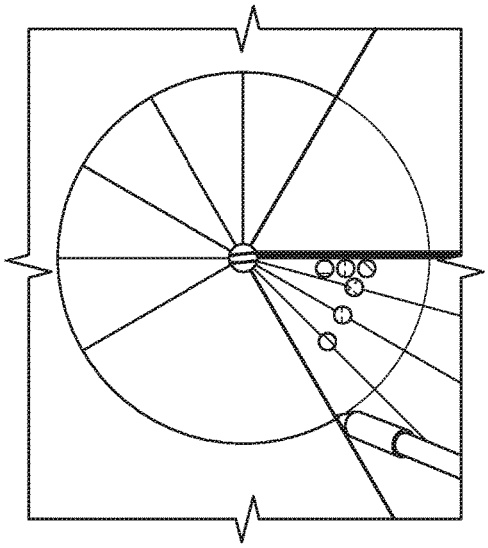
Figure 12F:
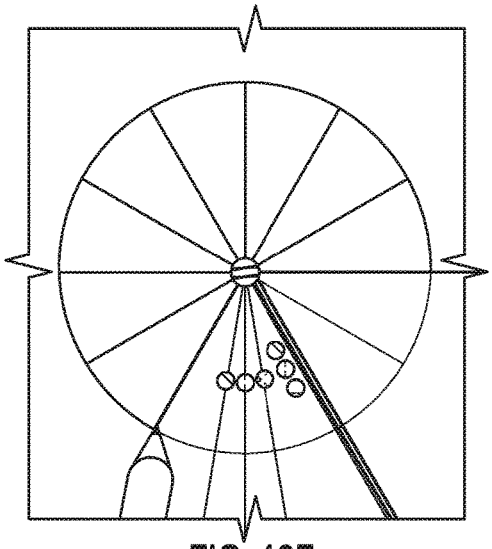
Figure 12G:
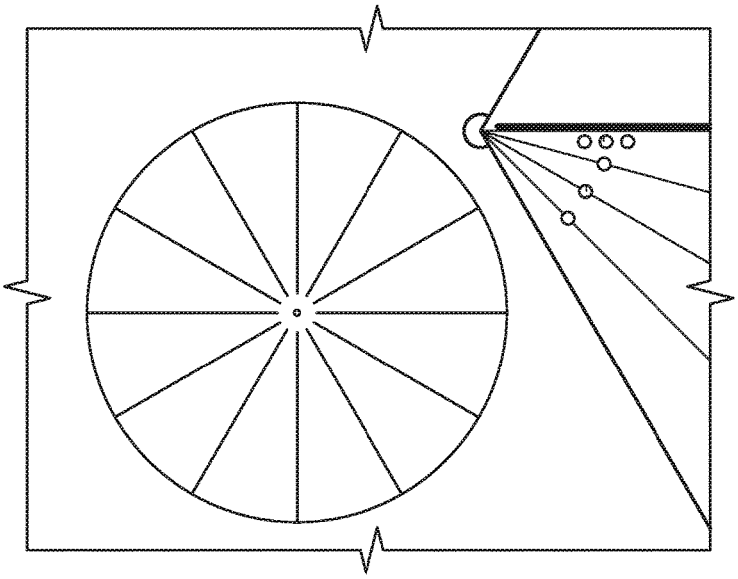

The edges and slits of the tools 1000, 1100 can be used to divide circles into segments. As an illustration, FIGS. 12A-12G show dividing into $12^{ths}$. For drawing with the tool 1000, the tool 1000 is initially positioned with its edge 1015 (containing the Tool name—"TriLiner") where the first division line is to be drawn. Lines are then drawn on the surface of the material along both edges 1015, 1017 of the tool 1000, and as indicated by the color-coding, along the lined edge (guide line 1005) of the slit 1004. (FIG. 12A). The tool 1000 is rotated before drawing the next set of segment lines. The 1000 is rotated clockwise to position a printed segment line on the tool 1000 directly over the top of a previously drawn segment line (FIG. 12B). If the shape is being divided into $12^{ths}$ or $18^{ths}$, then the printed line 1014 with the number "12" or "18" is the one that is positioned over a previously drawn line. These lines also have color-coded dots 1024, 1026, respectively, as shown in FIG. 10. Once the tool 1000 is positioned, the edges 1015, 1017 are used as guides to draw the next set of dividing lines (FIG. 14C).

FIGS. 12D-12G show completion of the segmentation into $12^{ths}$. The slit 1004 is used to accelerate dividing the shape into the desired number of segments for some but not all of the segment numbers. The slit 1004 offers an additional "edge" to draw segment dividing lines. To indicate when to use the slit 1004, colored dots on the surface of the tool 1000 are positioned along the edge of the slit. If a colored dot on the slit 1004 matches the colored dot on the segment line 1014 being used to divide the shape, then the slit 1004 can also be used to draw another segment line on the surface to be marked, increasing the number of lines that can be drawn with each tool 1000 rotation. If the slit 1004 does not have a colored dot that matches the colored dot on the printed segment dividing line 1014, then the slit 1014 is not used.

Using the edges 1015, 1017 and slit 1004, the tool 1000 is rotated and lines are drawn as described above until all of the desired lines are drawn on the surface to be marked.

For dividing into $3^{rds}$, markings are made at edges 1015 and 1017, and the tool 1000 is rotated to align a marking originally along edge 1015 with edge 1017, whereupon another marking may be made, resulting in a division of the shape into thirds. For 6ths, markings are made at the edges 1015 and 1017, and the slit 1004, and the tool 1000 is rotated to align edge 1017 with the marking originally made at edge 1015, whereupon additional markings can be made. The tool is rotated again in a similar fashion to complete the markings. For dividing into 18ths, markings are made at edges 1015 and 1017 and slit 1004; the tool 1000 is rotated until the $18^{ths}$ line overlays the line originally drawn at edge 1015 and markings are made at the edges 1015, 1017, and at slit 1004; the tool 1000 is rotated until the $18^{ths}$ line overlays the next line originally drawn at edge 1015 and markings are made at the edges 1015, 1017, and at slit 1004; the tool may then be rotated further to align edge 1017 with the last edge marked at original edge 1015, and the process repeated until all 18ths are marked.

Figure 13A:
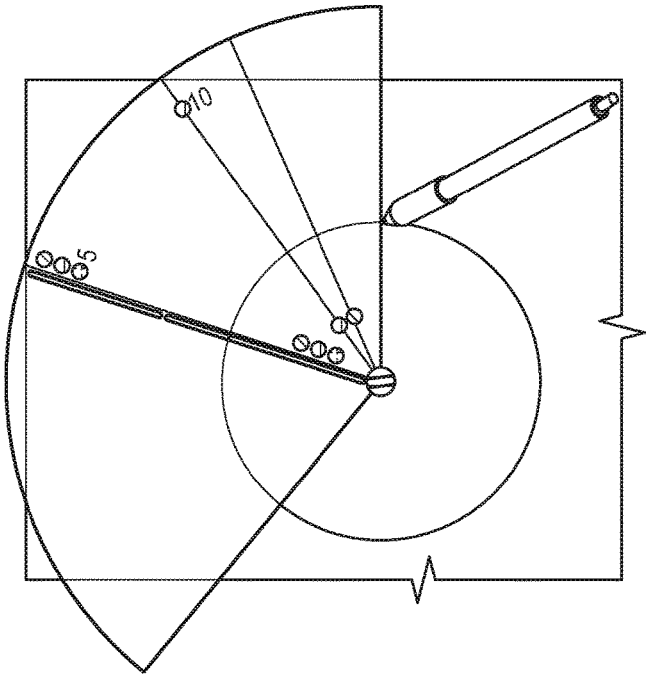
FIG. 13A-13F shown a tool in use to segment a shape into 10 segments.
Figure 13B:
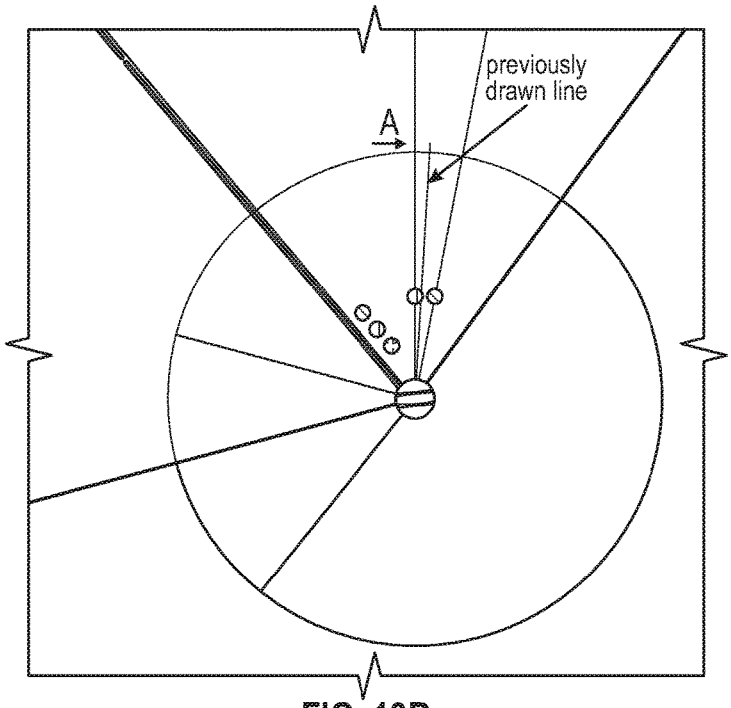
Figure 13C:
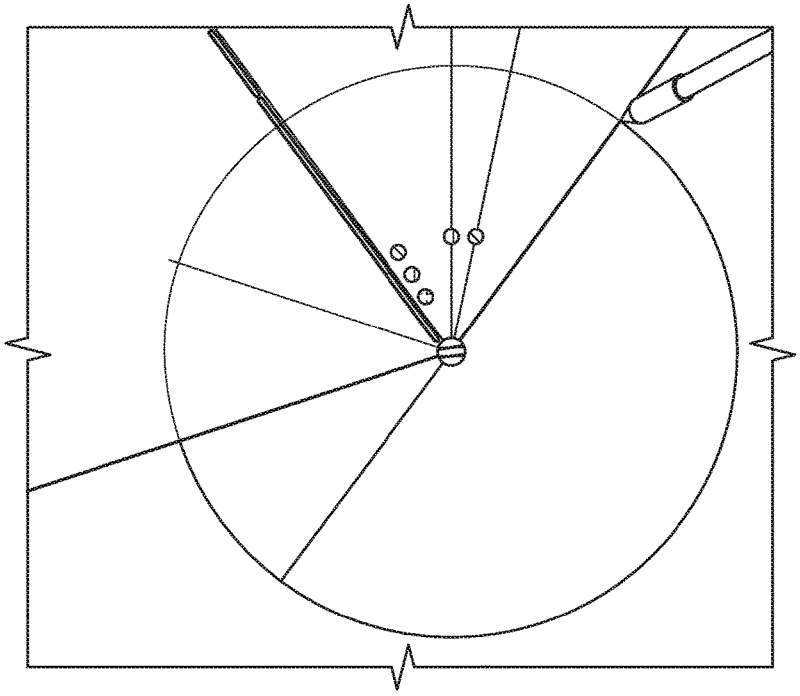
Figure 13D:
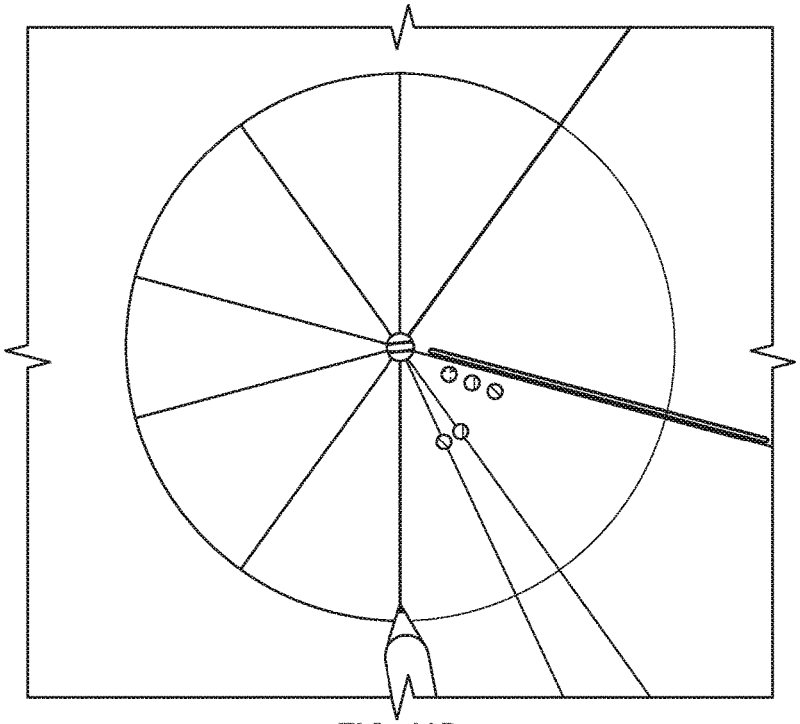
Figure 13E:
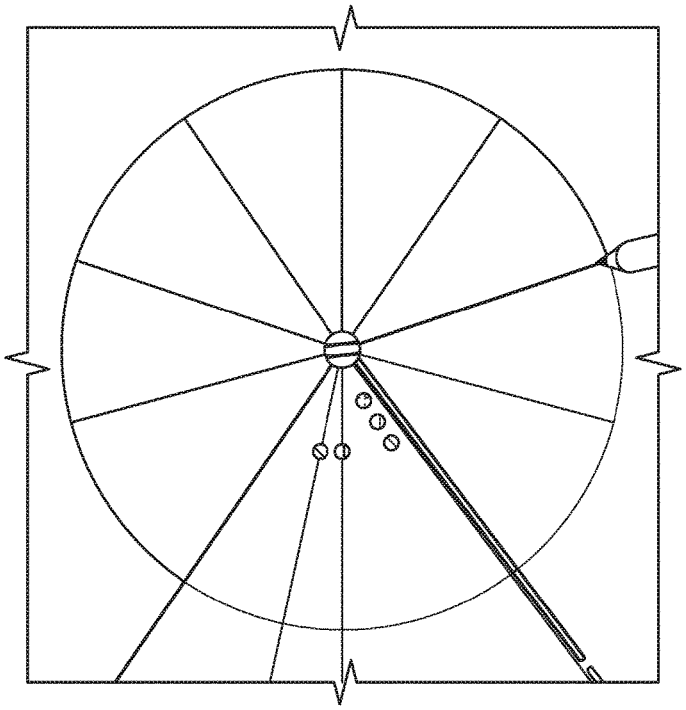
Figure 13F:
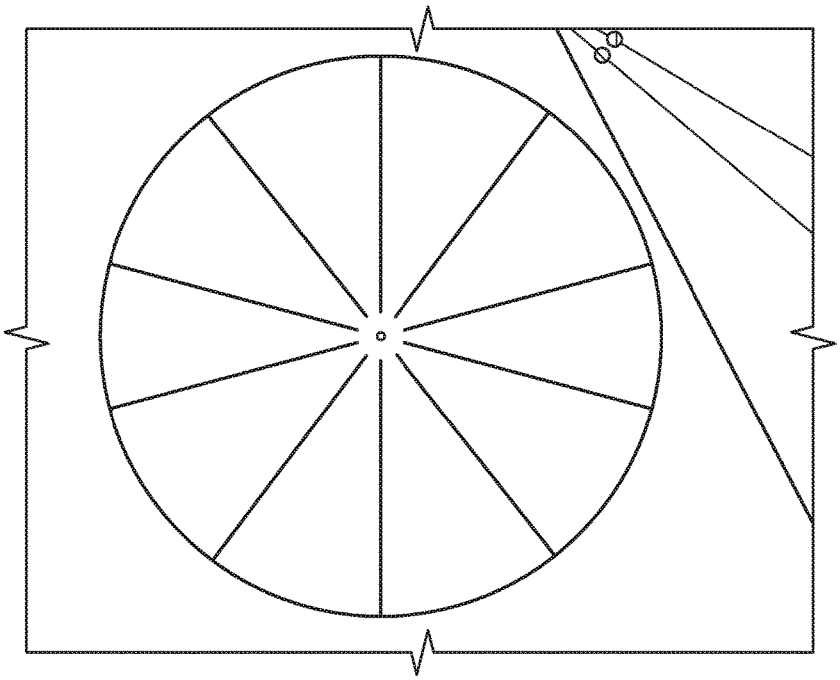

FIGS. 13A-13F illustrate use of tool 1100 to divide a circle into 10 segments. The tool is connected to the material with the tack 202 and cap 204 as described above, and markings are made along edges 1115, 1117, and slit 1104 (FIG. 13A). The tool 1100 is rotated (FIG. 13B) to align the $10^{th}$ line with the line originally drawn at edge 1115 and markings are made at edges 1115, 1117, and slit 1104 (FIG. 13C). As half of the required markings are made, the tool 1100 is rotated so that the edge 1117 aligns with the last marking made at edge 1115 (FIG. 13D). Markings are made at the slit 1104 and edge 1117 (FIG. 13E). Repeat rotation to align the $10^{th}$ line with the last marking made at edge 1115, mark edge 1117 and slit 1104 (FIG. 13F) to complete divisions of 10.

For dividing into $5^{ths}$, attach tool 1110; mark at edges 1115, 1117, and slit 1104; rotate to align edge 1117 with marking originally at edge 1115; and mark edge 1115 and slit 1104 to complete. For dividing into $15^{ths}$, attach tool 1100; mark at edges 1115, 1117, and slit 1104; rotate to align $15^{th}$ marking line 1114 with marked line originally from edge 1115; mark edges 1115, 1117, and slit 1104; repeat rotation and marking; rotate until edge 1117 aligns with last marking at edge 1115; mark slit 1104 and edge 1115; rotate until $15^{th}$ line overlays last marking at edge 1115; mark edge 1117 and slit 1104; repeat to complete.

Attaching the Tools to a Mid or Longarm

Figure 9:
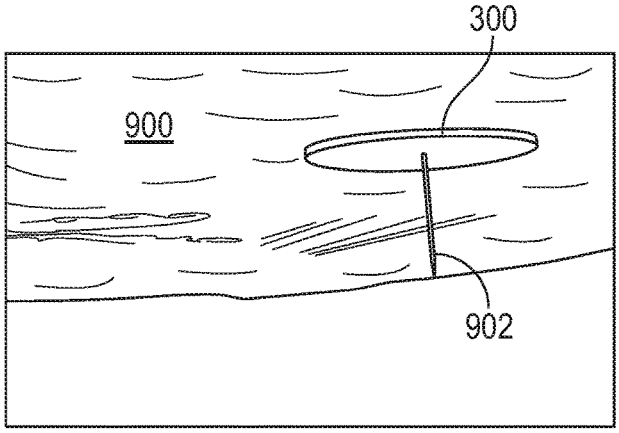
FIG. 9 is a perspective view of a mounting embodiment of the present disclosure.

In the fabric surface design industry, the tool 100 can also be attached to a fabric surface of a fabric, such as fabric 900 shown in FIG. 9, while the fabric is affixed to a frame (known as a longarm or midarm) by using a corsage pin 902 and the backing disk 300 (in one embodiment a 2" diameter× 1/16" thick rubber disk). With the tool 100 placed on the surface to be marked, and centered over the circle to be marked, the corsage pin 902 is pushed through the centering hole of tool 100 and through the surface of the material 900. The backing disk 300 is held directly beneath the spot where the pin 902 will come through the surface of the material 900 and the corsage pin 902 is pushed through the backing disk 300 until the disk 300 is snugged up to the lower surface of the fabric 900. The backing disk 300 allows the tool 100 to rotate with precision, while providing a backing support therefor.

Although the present disclosure has been made with reference to preferred embodiments, workers skilled in the art will recognize that changes may be made in form and detail without departing from the scope of the disclosure.

What is claimed is:

1. A tool for inscribing markings onto a medium, comprising:

a circular body, the circular body having a mounting hole in a center of the circular body, and at least one slit extending in a line that intersects the center toward an outer edge of the circular body; and a plurality of drawing holes in a face of the circular body, each drawing hole a different predetermined radial distance from the mounting hole;

wherein the at least one slit has a guide line inscribed on a side of the slit, the guide line aligning the side of the slit for marking a line using the slit, the alignment line positioned on the edge of the slit at which a line is to be drawn.

2. The tool of claim 1, wherein the at least one slit comprises a plurality of eight slits arranged at 45 degree increments around the circular body.

3. The tool of claim 1, and further comprising a plurality of circular cutouts of varying size in a face of the circular body.

4. The tool of claim 1, and further comprising a plurality of marking lines extending along the line that intersects the center toward an outer edge of the circular body, each marking line arranged at a 45 degree increment from its adjacent marking line around the circular body, and each marking arranged halfway between adjacent slits, wherein the marking lines are spaced 22.5 degrees from adjacent slits.

5. The tool of claim 1, and further comprising a thumb tack, a corsage pin, a cap, and a rubber disc configured to secure the tool to the medium, the thumb tack and cap for securing the tool to a flat surface, and the corsage pin and rubber disc for securing the tool to a suspended surface.

6. A tool for inscribing markings onto a medium, comprising:

a circular body, the circular body having a mounting hole in a center of the circular body, and at least one slit extending in a line that intersects the center toward an outer edge of the circular body;

a plurality of drawing holes in a face of the circular body, each drawing hole a different predetermined radial distance from the mounting hole;

a plurality of marking lines extending along the line that intersects the center toward an outer edge of the circular body, each marking line arranged at a 45 degree increment from its adjacent marking line around the circular body, and each marking arranged halfway between adjacent slits, wherein the marking lines are spaced 22.5 degrees from adjacent slits; and a plurality of circular cutouts of varying size in a face of the circular body, wherein each of the plurality of circular cutouts is divided into quarters by a marking line of the plurality of marking lines and a secondary marking line perpendicular to the respective marking line;

wherein the at least one slit comprises a plurality of eight slits arranged at 45 degree increments around the circular body.

7. A tool for inscribing lines onto a medium, comprising:

a wedge-shaped body, the wedge-shaped body encompassing a predetermined arc and having a mounting hole and at least one slit extending from the mounting hole toward an outer edge of the circular body, the slit having an alignment line along an edge of the slit, the alignment line positioned on the edge of the slit at which a line is to be drawn; and a plurality of coded dots on a face of the tool, the plurality of coded dots including a color representing each segmented size of division of a circle of the tool;

wherein each coded dot on a slit matches a corresponding coded dot on at least one segment line for the division of the circle into segment size associated with the coded dot.

8. The tool of claim 7, wherein the at least one slit with an alignment line bisects the wedge-shaped body.

9. The tool of claim 7, and further comprising a plurality of printed lines on a face of the wedge-shaped body, each of the plurality of lines at a predetermined angle from an edge of the wedge-shaped body, configured such that the tool may be used to divide a shape into equal segments without the need for mathematical calculations using the one or more of edges of the wedge-shaped body, the plurality of lines, and the slit.

10. The tool of claim 9, wherein the predetermined arc is 144 degrees.

11. The tool of claim 10, wherein the plurality of printed lines are at 24 degrees, 36 degrees, and 72 degrees from an edge of the wedge-shaped body.

12. The tool of claim 9, wherein the predetermined arc is 120 degrees.

13. The tool of claim 12, wherein the plurality of printed lines are at 20 degrees, 30 degrees, 40 degrees, and 60 degrees from an edge of the wedge-shaped body.

14. A method of inscribing circles and dividing circles into equal segments, comprising:

attaching a marking tool to a material using a center mounting hole; and inscribing a circle using one of a plurality of radius holes in the marking tool, the plurality of radius holes in a face of the marking tool, each radius hole of the plurality of radius holes having a different predetermined distance from the mounting hole; and dividing the inscribed circle using at least one slit in the marking tool, the slit having an alignment line along an edge of the slit, the alignment line positioned on the edge of the slit at which a line is to be drawn.

15. The method of claim 14, wherein dividing the inscribed circle further comprises marking along at least two collinear slits.

16. The method of claim 14, wherein dividing the inscribed circle further comprises attaching an extender tool to the center opening, the extender tool having a plurality of holes each at a different distance from the center mounting hole, and inscribing a circle of a larger radius than the marking tool using the extender.

17. The method of claim 16, wherein dividing the inscribed circle of a larger radius than the marking tool using the extender comprises using a slit in the extender to divide the inscribed circle at the larger radius.

18. The method of claim 14, wherein attaching the tool to the medium comprises one of attaching to a flat surface by using a thumbtack point up through the mounting hole and the medium and capped with a thumbtack cap, and attaching to a suspended surface using a rubber disc beneath the medium and a corsage pin through the mounting hole and the medium and the rubber disc.

* * * * *